United States Patent [19]

Culshaw et al.

[11] Patent Number: 5,051,212

[45] Date of Patent: Sep. 24, 1991

[54] HARD-SURFACE CLEANING COMPOSITIONS CONTAINING IMINODIACETIC ACID DERIVATIVES

[75] Inventors: Stephen Culshaw, Le Pecq, France; Eddy Vos, Linden, Belgium; Frederick E. Hardy, Ponteland, England

[73] Assignee: The Procter & Gamble Company, Cincinnati, Ohio

[21] Appl. No.: 269,850

[22] Filed: Nov. 9, 1988

[30] Foreign Application Priority Data

Nov. 13, 1987 [GB] United Kingdom ..... 8726673

[51] Int. Cl.[5] ..... C11D 7/32; C11D 7/22; C11D 7/26; C11D 7/00

[52] U.S. Cl. ..... 252/546; 252/541; 252/544; 252/106; 252/154; 252/155; 252/170; 252/173; 252/153; 252/DIG. 11

[58] Field of Search ..... 252/170, 173, 153, 546, 252/DIG. 11, 106, 154, 541, 155, 544

[56] References Cited

U.S. PATENT DOCUMENTS 4,769,172 9/1988 Siklosi ..... 252/153

FOREIGN PATENT DOCUMENTS 59-70652 4/1984 Japan .

OTHER PUBLICATIONS

Majer et al., "Neue Komplexane, XXXVIII, D.L--N-(2,3-Dihydroxypropyl)-N-Karboxymethylaminoessigsare Synthese, Studiun der Azidobasischen Eigerschaften, Chelatbildung mit Kationen der Erdalkalimetalle und mit Zweiwertigen Kationen von Schwermetallen", *Chem. ZUESTI*, vol. 34, No. 1, pp. 93-103 (1980).

CRC Handbook of Chemistry and Physics, 58th Edition, p. C-460 (1977).

Booy, M. "Chelating Agents in High Temperature Chemistry", *Canadian Journal of Chemistry*, vol. 55, 1977, p. 1764.

*Primary Examiner*—Paul Lieberman
*Assistant Examiner*—Kevin D. McCarthy
*Attorney, Agent, or Firm*—Robert B. Aylor; Richard C. Witte

[57] ABSTRACT

Hard-surface cleaning compositions are disclosed, containing an organic solvent having a boiling point above 90° C., and a chelating agent derived from iminodiacetic acid.

10 Claims, No Drawings

HARD-SURFACE CLEANING COMPOSITIONS CONTAINING IMINODIACETEC ACID DERIVATIVES

TECHNICAL FIELD

The present invention relates to hard-surface cleaning compositions containing a binary mixture of an organic solvent and a narrowly defined organic chelating agent derived from iminodiacetic acid.

BACKGROUND OF THE INVENTION

It is well known to formulate hard-surface cleaning compositions, containing organic solvents and chelating agents.

European Patent Application 0 040 882, 0 080 749, 0 126 545 describe the use of solvents represented by mixtures of terpenes with benzyl alcohol or butyl carbitol, together with builders which are mainly polyphosphates, or nitrogen containing strong sequestrants like NTA.

EP 0 105 863 and U.S. Pat. No. 3,591,510 describe the use of certain glycol ether derivatives as solvents in liquid cleansers, together with polyphosphate builders.

The above solvent/builder combinations have proven very effective; however, in recent years phosphates have come under scrutiny for environmental reasons.

Iminodiacetic acid derivatives are known to possess metal sequestering properties, and several compounds of the type have been synthesised and investigated for this purpose.

The compounds N-2-hydroxyethyl-N, N-diacetic acid and N-diethyleneglycol-N, N-diacetic acid and N(1-hydroxypropyl) imino N, N-diacetic acid have been disclosed in Japanese Laid-Open Application 59/70652;

Other iminodiacetic derivatives such as N(-2-hydroxypropyl)imino N, N-diacetic acid, and di-hydroxypropyl imino (N,N,diacetic acid) are disclosed in DE-OS 23 14 449, and DE-OS 25 42 708;

There has been no disclosure, however, of the chelating agents described herein, in combination with organic solvents according to the present invention.

It has now been surprisingly discovered that the combination of the chelating agents herein with certain organic solvent provide very good results in terms of soil removal from hard surfaces.

It is therefore the object of the present invention to provide efficient hard surface cleaning compositions containing the combination of a chelating agent derived from iminodiacetic acid, and a suitable organic solvent.

SUMMARY OF THE INVENTION

The present invention relates to hard-surface cleaning compositions containing an organic solvent having a boiling point above 90° C., and a specific chelating agent derived from iminodiacetic acid, such as defined in detail hereinafter.

DETAILED DESCRIPTION OF THE INVENTION

The chelating agent

The chelating agents herein have the following formula:

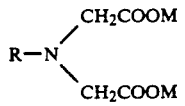

wherein R is selected from the group of $-CH_2CH_2CH_2OH$; $-CH_2CH(OH)CH_3$;

$-CH_2CH(OH)CH_2OH$; $-CH(CH_2OH)_2$;

$-CH_3$; $-CH_2CH_2OCH_3$; $-\underset{\underset{O}{\|}}{C}-CH_3$; $-CH_2-\underset{\underset{O}{\|}}{C}-NH_2$;

$-CH_2CH_2CH_2OCH_3$;

$-C(CH_2OH)_3$ and M is hydrogen or an alkalimetal ion.

Chemical names of the chelating agents herein are: N(3-hydroxypropyl)imino N, N-diacetic acid (3-HPIDA), N(-2-hydroxypropyl)imino N, N-diacetic acid (2-HPIDA), N-glyceryl imino N, N-diacetic acid (GLIDA), di-hydroxy iso-propyl imino (N,N) diacetic acid (DHPIDA), methyl imino (N,N) diacetic acid (MIDA) 2-methoxy ethyl imino (N,N) diacetic acid. (MEIDA), amidoiminodiacetic acid (also known as sodium amidonitrilotriacetic, SAND), acetamidoiminodiacetic acid (AIDA). 3-methoxy propylimino N,N-diacetic acid (MEPIDA), tris (hydroxymethyl) methylimino N,N-diacetic acid (TRIDA)

Methods of preparation of the iminodiacetic derivatives herein are disclosed in the following publications:

Japanese Laid Open publication 59-70652, for 3-HPIDA

DE-OS-25 42 708, for 2-HPIDA, and DHPIDA

Chem. ZUESTI 34(1) pp. 93-103 (1980) MAYER, RIECANSKA, et al publication of Mar. 26, 1979 for GLIDA.

C.A. 104(6)45062 d for MIDA.

Biochemistry 5, p. 467 (1966) for AIDA

The chelating agents of the invention are present at levels of from 1% to 20% of the total composition, preferably 2% to 10%.

THE ORGANIC SOLVENT

It has been found that the organic solvents suitable for use in combination with the above-described chelating agents must have a boiling point equal to or above 90° C., in order to give the unexpected soil-release benefits derivable from the solvent-chelating agent combination.

For instance, $C_1$–$C_3$ aliphatic alcohols like isopropanol (B.P. 82° C.) are not suitable for use in the present invention.

Representatives of organic solvents which are effective in the present context are: $C_6$–$C_9$ alkyl aromatic solvents, especially the $C_6$–$C_9$ alkyl benzenes, alpha-olefins, like 1-decene or 1-dodecene, benzyl alcohol, n-hexanol, phthalic acid esters.

A type of solvent especially suitable for the compositions herein comprises diols having from 6 to 16, preferably 8 to 12, carbon atoms in their molecular structure. Preferred diol solvents have a solubility in water of from about 0.1 to about 20 g/100 g of water at 20° C. The most preferred diol solvents are 2,2,4-trimethyl-1,3-pentanediol, and 2-ethyl-1,3-hexanediol.

Glycol ethers are another class of particularly preferred solvents.

In this category, are: water-soluble CARBITOL ® solvents or water-soluble CELLOSOLVE ® solvents. Water-soluble CARBITOL ® solvents are compounds of the 2-(2-alkoxyethoxy)ethanol class wherein the alkoxy group is derived from ethyl, propyl, butyl pentyl hexyl; a preferred water-soluble carbitol is 2-(2-butoxyethoxy)ethanol also known as butyl carbitol. Preferred are also hexyl carbitol and 2-methyl pentyl carbitol. Water-soluble CELLOSOLVE ® solvents are compounds of the 2-alkoxyethoxy ethanol class, wherein the alkoxy group is preferably butyl or hexyl.

Still in the glycol ether category, certain propyleneglycol derivatives have been found to be particularly efficient in the present context; these species include 1-n-butoxypropane-2-ol, and 1(2-n-butoxy-1-methylethoxy)propane-2-ol (butoxypropoxypropanol), with the latter being especially preferred.

Mixtures of the above solvents can also be used, like Butyl carbitol and/or Benzyl alcohol together with diols and/or glycol ethers.

The organic solvent is present at level of from 1% to 20% by weight of the total composition, preferably from 1% to 10%.

CHELATING AGENT/SOLVENT COMBINATION

The benefits of the present compositions are derived from the combination of the specific chelating agents and organic solvents described hereinabove.

They are particularly noticeable in terms of calcium soap-soil removal from surfaces such as bathtub surfaces.

In order to obtain such an effect, the weight ratio or organic solvent to chelating agent is in the range from ⅔ to 2/1, preferably 1/1 to 2/1.

OPTIONAL INGREDIENTS

In addition to the essential chelating agent/solvent binary mixture described hereinabove, the compositions of the invention can contain additional ingredients, which are often highly desirable.

The compositions herein will usually contain a surface-active agent.

Water-soluble detersive surfactants useful herein include well-known synthetic anionic, nonionic, cationic, amphoteric and zwitterionic surfactants and mixtures thereof. Typical of these are the alkyl benzene sulfates and sulfonates, paraffin sulfonates, olefin sulfonates, alkoxylated (especially ethoxylated) alcohols and alkyl phenols, amine oxides, sulfonates of fatty acids and of fatty acid esters, and the like, which are well-known in the detergency art. In general, such detersive surfactants contain an alkyl group in the $C_{10}$–$C_{18}$ range; the anionic detersive surfactants are most commonly used in the form of their sodium, potassium or triethanolammonium salts. The nonionics generally contain from 3 to 17 ethylene oxide groups per mole of hydrophobic moiety. Cationic surfactants will generally be represented by quaternary ammonium compounds such as ditallow dimethyl ammonium chloride, and will be preferably used in combination with nonionic surfactants.

Especially preferred in the compositions of the present invention are: $C_{12}$–$C_{16}$ alkyl benzene sulfonates, $C_{12}$–$C_{18}$ paraffin-sulfonates and the ethoxylated alcohols of the formula $RO(CH_2CH_2O)_n$, with R being a $C_{12}$–$C_{15}$ alkyl chain and n being a number from 6 to 10, and the ethoxylated alcohol sulfates of formula $RO—(CH_2CH_2O)_n—SO_3M$, with R being a $C_{12}$–$C_{18}$ alkyl chain on a number from 2 to 8, and M is H or an alkalimetal ion.

Anionic surfactants are frequently present at levels from 0.3% to 8% of the composition. Nonionic surfactants, are used at levels between 0.1% to 6% by weight of the composition. Mixtures of the like surfactants can also be used.

Other optional ingredients are represented by conventional detergency builders, which may be used in addition to the chelating agent herein; compounds classifiable and well-known in the art as detergent builders include the nitrilotriacetates (NTA), polycarboxylates, citrates, water-soluble phosphates such as tri-polyphosphate and sodium ortho- and pyro-phosphates, silicates, ethylene diamine tetraacetate (EDTA), amino-polyphosphonates (DEQUEST), phosphates and mixtures thereof.

Highly desirable ingredients for use herein are represented by conventional detergent hydrotropes. Examples of suitable hydrotropes are urea, monoethanolamine, diethanolamine, triethanolamine and the sodium potassium, ammonium and alkanol ammonium salts of xylene-, toluene-, ethylbenzene- and isopropyl-benzene sulfonates.

The hard-surface cleaning compositions of the invention may also contain an abrasive material.

The abrasives suitable herein are selected from water-insoluble, non-gritty materials well-known in the literature for their relatively mild abrasive properties. It is highly preferred that the abrasives used herein not be undesirably "scratchy". Abrasive materials having a Mohs hardness in the range of about 7, or below, are typically used; abrasives having a Mohs hardness of 3, or below, can be used to avoid scratches on aluminum or stainless steel finishes. Suitable abrasives herein include inorganic materials, especially such materials as calcium carbonate and diatomaceous earth, as well as materials such as Fuller's earth, magnesium carbonate, China clay, actapulgite, calcium hydroxyapatite, calcium orthophosphate, dolomite and the like. The aforesaid inorganic materials can be qualified as "strong abrasives". Organic abrasives such as urea-formaldehyde, methyl methacrylate melamine-formaldehyde resins, polyethylene spheres and polyvinylchloride can be advantageously used in order to avoid scratching on certain surfaces, especially plastic surfaces.

Typically, abrasives have a particle size range of 10–1000 microns and are used at concentrations of 5% to 30% in the compositions. Thickeners are frequently added to suspend the abrasive.

Thickeners will preferably be included in the compositions of the inventions, mainly in order to suspend the abrasive; high levels of thickener are detrimental to the performance because they are difficult to rinse from the cleaned surfaces. Accordingly, the level will be kept under 2%, preferably from 0.2% to 1.5%. Common thickeners such as the polyacrylates, xanthan gums, carboxymethyl celluloses, swellable smectite clays, and the like, can be used herein.

Soaps can be included in the compositions herein, the soaps prepared from coconut oil fatty acids being preferred.

Optional components are also represented by ingredients typically used in commercial products to provide aesthetic or additional product performance benefits.

Typical ingredients include perfumes, dyes, optical brighteners, soil suspending agents, detersive enzymes, gel-control agents, thickeners, freeze-thaw stabilizers, bactericides, preservatives, and the like.

PREFERRED EXECUTIONS OF THE COMPOSITIONS

The hard-surface cleaning compositions herein will advantageously be executed in the form of an aqueous liquid compositions, including concentrates, containing as essential ingredients a surface-active agent, and the solvent/chelating agent binary mixture according to the invention.

Liquid executions at normal dilution usually contain 2–6% surfactant and 8–12% solvent/chelating agent binary mixture.

Concentrated liquid executions usually contain 6–10% surfactant and 16–24% solvent/chelating agent binary mixture.

Alternatively, the compositions herein will be in the form of a creamy scouring cleanser, containing an abrasive material, surface-active agent, and the solvent/-chelating agent binary mixture of the invention.

In both executions, the pH of such compositions will be neutral or in the alkaline range, generally in the range of pH 5–11.

The following examples are given by way of illustrating the compositions herein, but are not intended to be limiting of the scope of the invention.

The following hard-surface cleaning compositions are prepared:

| Abbreviations | |
|---|---|
| NaPS | Sodium $C_{13}$ to $C_{16}$ paraffin sulfonate |
| LAS | Sodium salt of linear $C_{11}$–$C_8$ alkyl benzene sulfonate |
| Lutensol$^R$AO$_7$ | Condensate of 1 mole $C_{12}$–$C_{14}$ fatty alcohol with 7 moles of ethylene oxide |
| Lutensol$^R$AO$_3$ | Condensate of 1 mole $C_{12}$–$C_{14}$ fatty alcohol with 3 moles of ethylene oxide |
| Neodol 25E3S | Sulfated condensate of 1 mole $C_{12}$–$C_{15}$ fatty alcohol with 3 moles ethylene oxide |
| HCnFA | Narrow cut, hardened, coconut fatty acid |
| ETHD | 2-Ethyl-1,3-hexanediol |
| BPP | Butoxy Propoxy Propanol = 1(2-n-butoxy-1-methylethoxy)propane-2-ol |

-continued

| Abbreviations | |
|---|---|
| NaCS | Sodium cumene sulfonate |
| Sokolan$^R$PHC25 | Crosslinked polyacrylate thickener |
| GLIDA | N-glyceryl imino N, N-diacetic acid |
| 3-HPIDA | N(1-hydroxypropyl)imino N, N-diacetic acid |
| 2-HPIDA | N(-2-hydroxypropyl)imino N, N-diacetic acid |
| DHPIDA | di-hydroxy propyl imino N,N diacetic acid |
| SAND | Sodium amidonitrilotriacetic acid |
| AIDA | Acetamido iminodiacetic acid |
| MEIDA | 2-methoxy ethyl imino N,N-diacetic acid |
| MIDA | N-Methyl, N, N diacetic acid |
| TRIDA | tris(hydroxymethyl) methyl imino N,N diacetic acid |

| | percent by weight | | | | | | | | | | |
|---|---|---|---|---|---|---|---|---|---|---|---|
| Ingredients | Ex I | Ex II | Ex III | Ex IV | Ex V | Ex VI | Ex VII | Ex VIII | Ex IX | Ex X | Ex XI |
| LAS | 0.5 | — | — | — | 4 | 3.0 | — | 0.5 | — | — | 0.5 |
| NaPS | 3.0 | 6.0 | 2.5 | 6.0 | — | 1.0 | 4.0 | 3.0 | 3 | 4.0 | 3.0 |
| Lutensol AO$_7$ | 0.2 | 2.0 | — | 2.0 | — | — | 0.2 | 0.2 | — | 0.2 | 0.2 |
| Lutensol AO$_3$ | — | — | 1.0 | — | — | 0.2 | — | — | 0.6 | — | — |
| Benzyl alcohol | — | — | — | — | — | 1.0 | — | — | — | — | — |
| Butyl Carbitol | — | 3.0 | — | 7.0 | — | — | — | 2.0 | 3.0 | — | — |
| ETHD | — | — | — | — | 6.0 | — | 2.0 | 3.0 | 2.5 | 2.0 | — |
| BPP | 6.0 | 7.0 | 6.0 | 3.0 | — | 4.0 | 2.0 | — | — | 2.0 | 6.0 |
| GLIDA | 4.0 | 10.0 | — | — | — | — | — | — | — | — | — |
| 3-HPIDA | — | — | 4.0 | 10.0 | — | — | — | — | — | — | — |
| 2-HPIDA | — | — | — | — | 4.0 | — | — | — | — | — | — |
| DHPIDA | — | — | — | — | — | 3.5 | — | — | — | — | — |
| MIDA | — | — | — | — | — | — | 3.0 | — | — | — | — |
| MEIDA | — | — | — | — | — | — | — | 3.5 | — | — | — |
| SAND | — | — | — | — | — | — | — | — | 4.0 | — | — |
| AIDA | | — | — | — | — | — | — | — | — | 3.5 | — |
| TRIDA* | — | — | — | — | — | — | — | — | — | — | 4.0 |
| $Na_2CO_3$ | 1.0 | 1.0 | 3.5 | 1.0 | 3.5 | 1.5 | 1.5 | 1.0 | 1.0 | 1.5 | 1.0 |
| NaCS | 2.0 | 2.5 | 8.0 | 1.5 | 8.0 | 2.5 | 2.5 | 2.0 | 2.5 | 2.5 | 2.5 |
| water & minors | | | | | | UP TO 100 | | | | | |

*TRIDA, tris (hydroxymethyl) methyl imino N,N diacetic acid, is prepared by the following reaction $2ClCH_2COONa + H_2NC(CH_2OH)_3 + Na_2CO_3 \rightarrow 2NaCl + CO_2 + H_2O + (HOCH_2)_3CN(CH_2COONa)_2$ The method is as follows:

A slurry of 0.86M 2-amino-2-hydroxymethyl-1,3-propandiol (TRIS) and 1.7M sodium chloracetate is prepared in a 500 ml water in a 1 liter conical flash fitted with a reflux condenser. 0.86M sodium carbonate are carefully added and heated to 50° C. for 4 hours then 95° C. for 6 hours. After cooling, the solution is acidified to dryness under reduced pressure.

The resulting solid is is extracted with hot ethanol and evaporated to dryness again. The solid is slurried in water and the pH adjusted to 11 with sodium hydroxide. Resaponification is conducted for 1 hour at 60° C., followed by evaporation to dryness.

The following creamy scouring compositions according to the invention are also prepared:

| | Ex XII | Ex XIII |
|---|---|---|
| LAS | — | 4.0 |
| NaPS | 4.0 | — |
| Lutensol AO7 | — | — |
| HCnFA | 2.0 | 1.5 |
| Benzyl alcohol | 1.0 | — |
| BPP | 3.0 | 4.0 |
| GLIDA | 3.0 | — |
| 1-HPIDA | — | — |
| $Na_2CO_3$ | 3.0 | 3.0 |
| $CaCO_3$ | 30.0 | — |
| Polyvinylchloride | — | 10.0 |
| Sokolan ® PHC25 | 0.4 | 0.4 |

The compositions prepared in accordance with Examples I to XII show very good performance in terms of kitchen and bathroom soil removal from hard surfaces, especially calcium soap soil removal from bathtub surfaces.

A composition containing isopropanol as solvent and GLIDA as builder, was found to be less efficient in terms of soil-removal properties, thus showing the criticality of the boiling point parameter used to select the solvents useful herein.

We claim:

1. A hard-surface cleaning composition containing an organic solvent having a boiling point above 90° C. and a chelating agent of the formula:

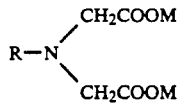

wherein R is selected from the group of $$-CH_2CH_2CH_2OH;\ -CH_2CH(OH)CH_3;$$

$$-CH_2CH(OH)CH_2OH;\ -CH(CH_2OH)_2;$$

$$-CH_3;\ -CH_2CH_2OCH_3;\ -\underset{\underset{O}{\|}}{C}-CH_3;\ -CH_2-\underset{\underset{O}{\|}}{C}-NH_2;$$

$$-CH_2CH_2CH_2OCH_3;$$

$$-C(CH_2OH)_3$$

and M is hydrogen or an alkali metal ion.

2. A composition in accordance with claim 1 wherein the organic solvent is present at levels of from 1% to 20% of the total composition and the chelating agent is present at levels of from 1% to 20% of the total composition.

3. A composition in accordance with claim 2 wherein the weight ratio of organic solvent to chelating agent is from $\frac{2}{3}$ to 2/1, preferably 1/1 to 2/1.

4. A composition in accordance with claim 1 wherein the organic solvent is selected from the group of benzyl alcohol, glycol ethers, and diols having 6 to 16 carbon atoms in their molecular structure.

5. A composition in accordance with claim 4 wherein the organic solvent is selected from the group of butoxypropanol, butoxypropoxypropanol, 2-(2-butoxyethoxy-ethanol, benzyl alcohol, 2,2,4,-trimethyl-1,3-pentanediol.

6. A composition in accordance with claim 5 wherein the organic solvent is butoxypropoxypropanol.

7. A composition in accordance with claim 1 which in addition contains an abrasive.

8 A composition in accordance with claim 1 wherein R is selected from the group consisting of: $-CH_2CH(OH)CH_2OH$; $-CH_2(CH_2OH)_2$; $-C(O)CH_3$; $-CH_2-C(L)-NH_2$; $-C_2CH_2CH_2OCH_3$; and $-C(CH_2OH)_3$.

9. A composition in accordance with claim 1 wherein R is selected from the group consisting of: $-CH_2CH(OH)CH_2OH$; $-CH_2(CH_2OH)_2$; $-C(O)CH_3$; $-CH_2-C(L)-NH_2$; $-C_2CH_2CH_2OCH_3$; $-C(CH_2OH)_3$; and $-CH_3$.

10. A hard-surface cleaning composition containing an organic solvent having a boiling point above 90° C. and a chelating agent comprising N-glyceryl, imino-N,N-diacetic acid or alkali metal salts thereof.

* * * * *

UNITED STATES PATENT AND TRADEMARK OFFICE

CERTIFICATE OF CORRECTION

PATENT NO. : 5,051,212

DATED : September 24, 1991

INVENTOR(S) : Stephen Culshaw; Eddy Vos; & Frederick E. Hardy

It is certified that error appears in the above-identified patent and that said Letters Patent is hereby corrected as shown below:

Col. 1, line 2, "IMINODIACETEC" should read -- IMINODIACETIC --.

Col. 3, line 36, "$\frac{2}{3}$" should read -- 2/3 --.

Col. 4, line 53, "abrasive" should read -- abrasives --.

IN THE CLAIMS:

Col. 8, line 5, "$\frac{2}{3}$" should read -- 2/3 --.

Col. 8, line 23, "(L)" should read -- (0) --.

Col. 8, line 28, "(L)" should read -- (0) --.

Signed and Sealed this

Fifth Day of October, 1993

*Attest:*

*Attesting Officer*

Bruce Lehman

BRUCE LEHMAN

*Commissioner of Patents and Trademarks*